United States Patent [19]

Sokolovsky

[11] 4,203,348

[45] May 20, 1980

[54] FIREARM APPARATUS

[76] Inventor: Paul J. Sokolovsky, 641 Torrington Dr., Sunnyvale, Calif. 94087

[21] Appl. No.: 859,047

[22] Filed: Dec. 9, 1977

[51] Int. Cl.[2] ..... F41C 17/08

[52] U.S. Cl. ..... 89/148; 42/70 D

[58] Field of Search ..... 42/66, 70 R, 70 L, 70 D, 42/70 E; 89/142, 148, 126, 127

[56] References Cited

U.S. PATENT DOCUMENTS

| | | | |
|---|---|---|---|
| 290,737 | 12/1883 | Brown | 42/70 C |
| 965,386 | 7/1910 | Hansen | 89/148 |
| 1,074,046 | 9/1913 | Castle | 42/70 R |
| 1,457,961 | 6/1923 | Browning | 89/148 |
| 1,702,984 | 2/1929 | Shelman | 42/70 R |
| 2,382,410 | 8/1945 | Garand | 89/148 |
| 2,386,205 | 10/1945 | Garand | 89/142 |
| 2,742,727 | 4/1956 | Asby | 42/70 R |

FOREIGN PATENT DOCUMENTS

| | | | |
|---|---|---|---|
| 330129 | 6/1930 | United Kingdom | 42/70 E |

*Primary Examiner*—Stephen C. Bentley
*Attorney, Agent, or Firm*—Warren M. Becker

[57] ABSTRACT

A firearm and in particular a pistol is described in which there is provided a novel self-retracting trigger-actuated safety mechanism for preventing involuntary firing of the firearm, a trigger-actuated magazine-latching mechanism for latching and releasing a magazine, a trigger-actuated firing and trigger release mechanism and a slide assembly safety mechanism for preventing firing of the firearm if the slide assembly is not in its firing position. In the self-retracting trigger-actuated safety mechanism there is provided a safety trigger member and a ball point pen point extending and retracting type mechanism including a safety mechanism linkage member which is selectively positioned in and withdrawn from the path of travel of a sear in the firing mechanism with successive actuations of the safety trigger member. In the trigger-actuated magazine-latching mechanism there is provided a trigger member and a spring-loaded pivoted latching member having a detent for releasably engaging a notch provided therefor in a magazine inserted in the firearm. In the trigger-actuated firing and trigger-release mechanism there is provided a firing trigger member, a sear-actuating slide for actuating a sear in the firing mechanism, a trigger-release actuator and a trigger-release slide for decoupling the trigger member from the sear-actuating slide upon firing of the firearm. In the slide assembly safety mechanism there is provided a member extending from the sear in the firing mechanism and a member extending from the slide for engaging the sear member for preventing a firing movement of the sear until the slide assembly is fully seated in its firing position.

18 Claims, 25 Drawing Figures

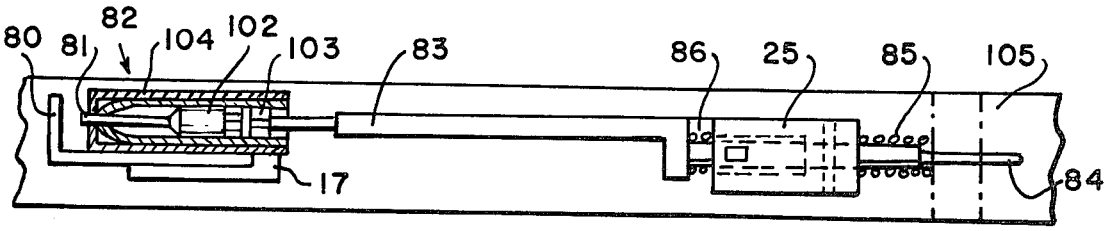
FIG. 20.
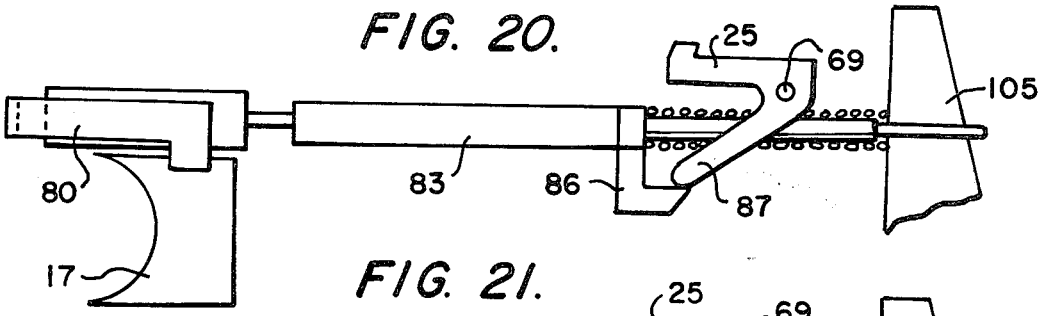
FIG. 21.
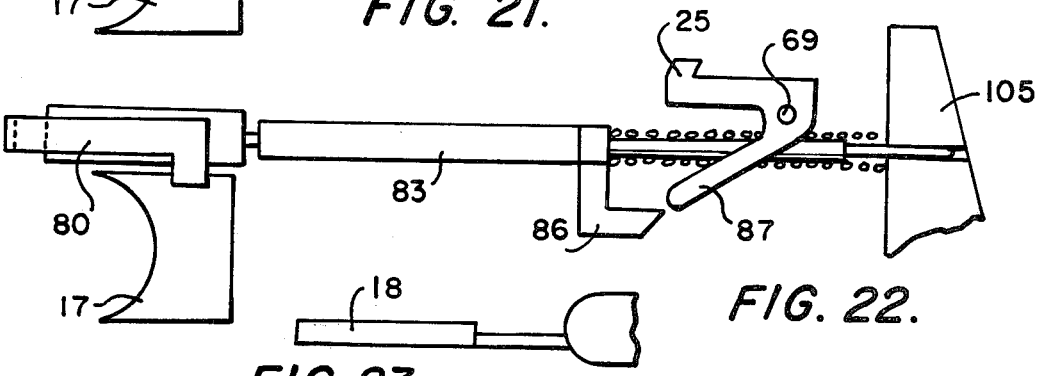
FIG. 22.
FIG. 23
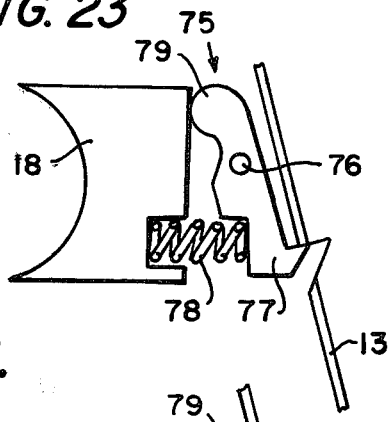
FIG. 24.
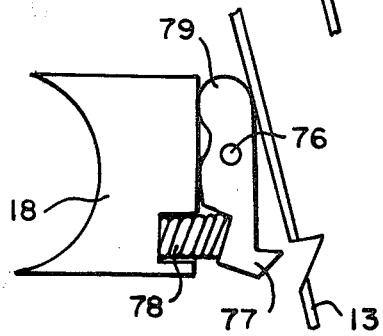
FIG. 25.

FIREARM APPARATUS

BACKGROUND OF THE INVENTION

The present invention relates to firearms in general and in particular to a novel safety mechanism, a magazine-latching mechanism and a firing trigger mechanism in a 45 caliber recoil-operated blowback type semi-automatic pistol and the like.

In conventional automatic and semi-automatic firearms there is generally provided a magazine for holding a plurality of rounds. Each of the rounds is automatically loaded into a chamber in the firearm and ejected therefrom upon the firing thereof. The magazine-latching mechanism and in particular the control for operating the magazine-latching mechanism, depending on the type of firearm, is typically located on the handle or the frame of the firearm. Similarly, the control for operating the firing safety mechanism of prior known firearms typically comprises a non-self-retracting lever, a button or the like which is located on the frame of the firearm. The controls of the magazine-latching mechanism and the safety mechanism of prior known firearms, being in exposed positions, are subject to being inadvertently dislodged. If these controls are dislodged inadvertently, serious safety-related problems can result. For example, if the control for the magazine-latching mechanism is dislodged inadvertently, it could result in a dislodging of the magazine itself from the firearm during a firing of the firearm. Similarly, if the control for the safety mechanism is dislodged inadvertently, the firearm could be placed in a condition for firing at a time when an operator of the firearm believes that the safety mechanism is on.

In addition to firearm safety related features, the appearance of a firearm is also very important. In the minds of many users, a firearm with clean lines and a minimum of externally protruding controls is pleasant to view and a pleasure to operate.

SUMMARY OF THE INVENTION

In view of the foregoing, a principal object of the present invention is a firearm comprising a novel firing assembly.

Another object of the present invention is a firearm comprising a novel safety assembly.

Another object of the present invention is a firearm comprising a novel magazine-latching assembly.

Still another object of the present invention is a firearm comprising a slide assembly having a novel slide safety mechanism.

Still another object of the present invention is a firearm comprising a magazine-latching mechanism, a safety mechanism and a firing mechanism, each of which is operated by a trigger member, and wherein the trigger members are positioned in side-by-side relationship in a trigger housing in the firearm.

Among the features of the present invention there is provided in the firing assembly a novel sear actuating mechanism and trigger release mechanism. The trigger release mechanism is provided for detaching the firing trigger member from the firing assembly after the firing of each round. In the firing safety mechanism, there is provided a ball point pen point extending and retracting type mechanism which is actuated by a self-retracting safety trigger member. As the trigger member is successively actuated, the extending and retracting mechanism is successively extended and retracted for extending and retracting a linkage member coupled thereto. The linkage member is provided for extending into the path of travel of the sear of the firearm when the safety mechanism is in its safety-on position. When the safety mechanism is in its safety-off position, the linkage member is retracted from the path of travel of the sear. When the linkage member is retracted from the path of travel of the sear, the sear is free to move for releasing a firing pin assembly provided in the firearm for firing the firearm. An indicating pin is also provided for providing a visual indication of the position of the linkage member relative to the sear.

In the magazine-latching mechanism there is provided a magazine-latching trigger member, a magazine latch and a spring member. The magazine latch is provided at one end with a detent. The detent is provided for releasably engaging a notch provided therefor in the wall of a magazine inserted in the firearm. The spring member is provided for resiliently forcing the magazine detent into the notch in the magazine and to oppose the operation of the magazine-latching trigger member.

In the slide safety mechanism there is provided a member extending from the sear in the firing mechanism and a member extending from the slide for engaging the sear member when the slide is not fully seated in its firing position. When the slide is fully seated in its firing position, the sear member clears the slide member allowing the sear to be actuated for actuating the firing pin assembly.

BRIEF DESCRIPTION OF THE DRAWINGS

The above and other objects, features and advantages of the present invention will become apparent from the following detailed description of the accompanying drawings in which:

FIG. 20 is a top plan view of a firing safety assembly according to the present invention.

FIG. 21 is a side elevation view of FIG. 20 with the apparatus of FIG. 21 in a "safety-on" position.

FIG. 22 is a side elevation view of the apparatus of FIG. 20 showing the position of the parts of the apparatus in a "safety-off" position.

FIG. 23 is a top plan view of a magazine latching assembly according to the present invention.

FIG. 24 is a side elevation view showing the apparatus of FIG. 23 latching a magazine.

FIG. 25 is a side elevation view of the apparatus of FIG. 24 showing a release of a magazine.

DETAILED DESCRIPTION

Figure 2:
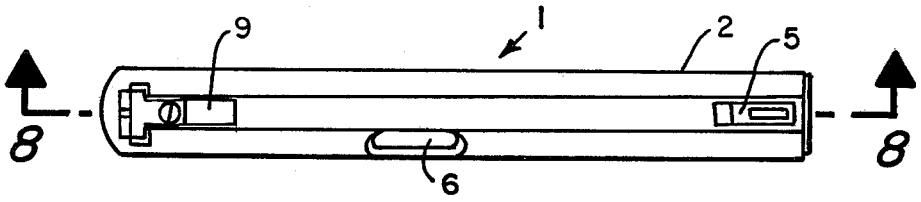
FIG. 2 is a top plan view of FIG. 1.

Referring to FIGS. 1–4 there is provided in accordance with the present invention, a 45 caliber recoil operated blow-back type semi-automatic pistol designated generally as 1. In the pistol 1 there is provided a slide assembly 2 and a frame assembly 3. In the slide assembly 2 there is provided at the upper rearend thereof a rear sight assembly 4. At the top and upper forward end thereof there is provided a forward or front sight assembly 5. Approximately in the middle of the slide assembly 2 and in the upper right side thereof there is provided an ejector hole 6. Ejector hole 6 is provided for ejecting spent shells from the firearm.

In the frame assembly 3 of the firearm 1 there is provided a handle designated generally as 10. Fitted to opposite sides of the handle 10 there is provided a pair of grip members 11 and 12. In the interior of the handle 10 there is provided a magazine receiving cavity for receiving a magazine 13. In a typical embodiment the magazine stores eight rounds or cartridges and is provided at its lower end with an outwardly extending flange which extends from the forward edge of the bottom of the handle 10 when the magazine is fully inserted in the handle. At the upper forward end of the handle 10 there is provided a trigger housing 15. The trigger housing 15 is provided for housing side-by-side a plurality of trigger members comprising a firing trigger member 16, a self-retracting safety trigger member 17 and a magazine latching trigger member 18.

Figure 1:
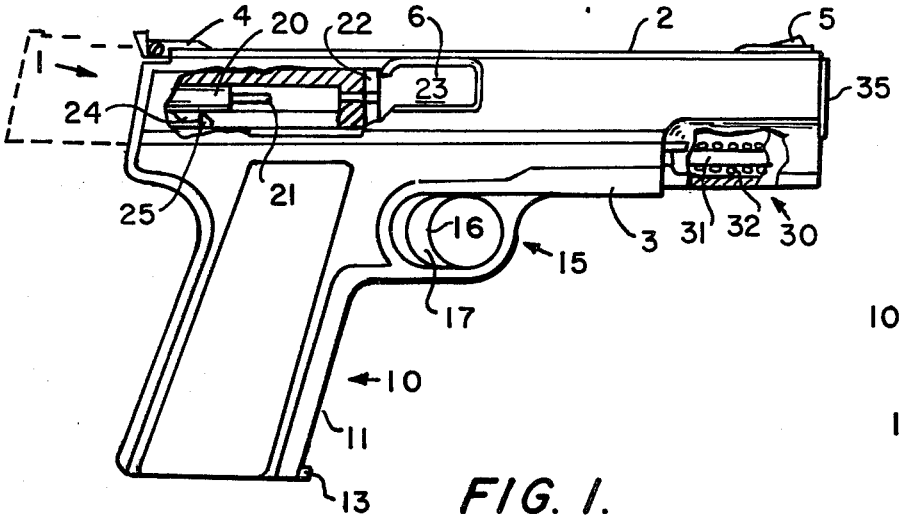
FIG. 1 is a right hand elevation view of a firearm according to the present invention.
Figure 3:
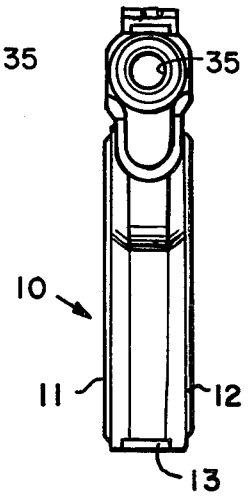
FIG. 3 is a front end elevation view of FIG. 1.
Figure 4:
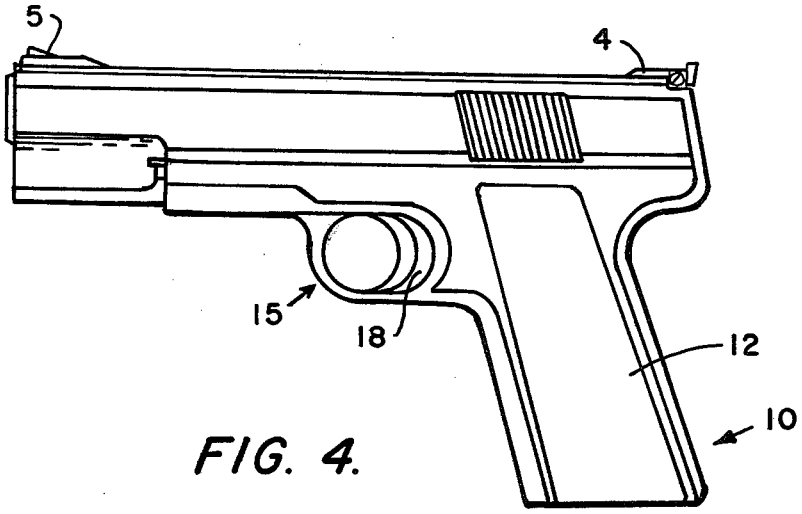
FIG. 4 is a left hand elevation view of FIG. 1.

Referring to FIG. 1 there is enclosed within the slide assembly 2 at the upper rearend of the frame assembly 3 a firing pin assembly 20. In the forward end of the firing pin assembly 20 there is provided a firing pin 21. The firing pin 21 is provided for passing through a hole provided therefor in a rear wall 22 of a firing chamber 23. Extending from the firing pin assembly 22 forming a integral part thereof there is provided a sear latching member 24 for engaging a sear member 25. As will be described in further detail below the sear member 25 engages the sear 24 for holding the firing pin assembly 20 and firing pin 21 in a cocked position when the slide assembly 2 is released to its forward position.

At the forward lower end of the slide assembly 2 there is provided a recoil spring receiving chamber 30. At the forward end of the frame assembly 3 there is provided a recoil spring pin 31 and on the pin 31, a recoil spring 32. The recoil spring 32 is fitted on the pin 31 and placed in the chamber 30 to provide for resiliently biasing the slide assembly 2 forward on the frame assembly 3. In practice, the spring 32 is constructed with a greater spring force than that used for constructing a spring in the firing pin assembly 20 and accordingly serves to cock the firing pin assembly 20 against the force of the firing pin assembly spring when the sear engaging member 24 engages the sear 25 as the slide assembly 2 is moved forward on the frame assembly 3 by the spring 32 following a recoil induced rearward movement.

Extending from the forward end of the firearm 1 and removably attached thereto there is provided a barrel 35.

Referring to FIGS. 5–8 of the slide assembly 2 there is provided in the rear sight assembly 4 a rear sight member 36 which is pivotably attached to the top of the slide assembly 2 by means of a rear sight pin. At the forward lower end of the slide assembly 2 there is provided the previously described recoil spring receiving chamber 30. At the rearend of the slide assembly 2 there is provided a firing pin assembly receiving chamber 38. Below the chamber 38 and on the left side of the slide assembly 2 there is provided a slide trigger safety detent 39. The slide trigger safety detent 39 is provided with a forward beveled surface 39 for slideably receiving a safety member extending laterally from the sear 25 when the slide assembly 2 is not in its firing position. This is for preventing a premature firing of the firearm. The shape of the sear member extending from the sear 25 for engaging the slide trigger safety detent conforms to the shape of the clearance space provided therefor shown to the right of the slide trigger safety detent 39 in FIG. 5.

To the right of the firing pin assembly chamber 38 there is provided a shell extractor 40. The shell extractor 40 is pivotably coupled to the slide assembly 2 by means of a pin 41. At the rear of the pin 41 there is provided a spring member 42. At the forward end of the extractor 40 there is provided a detent 43. In use, the spring 42 causes the detent 43 to engage the rim of a shell in the firing chamber as the shell is inserted therein and the slide assembly 2 closes to its firing position. Upon firing as the slide assembly 2 recoils the detent 43 pulls the shell asymmetrically causing it to be ejected through the shell ejector hole 6.

Forward of the rear wall 22 of the firing chamber 23 there is provided a plurality of machined interior wall surfaces 45, 46 and 47. The surfaces 45, 46 and 47 are provided for providing a snug fit between the barrel 35 and the slide assembly 2. Forward of the surface 46 and on the left side of the slide assembly 2 there is provided a slide stop receiving recess 48.

Referring to FIGS. 9–15, there is provided in the handle 10 of the frame assembly 3 a magazine receiving cavity 50 for receiving the magazine 13 described above with respect to FIG. 1. At the inner end of the recoil spring receiving pin 31 there is provided a spring backup bracket 51. To the rear of the spring backup bracket 51 there is provided a plurality of barrel detents 52. The barrel detents 52 are provided for engaging corresponding notches provided therefor in the barrel 35 to removably secure the barrel 35 on the frame 3 in the slide assembly 2. Beneath each of the barrel detents 52 there is provided a barrel detent spring member 53. The spring members 53 are provided for applying a spring force to the barrel detents 52 for holding the barrel detents 52 in the corresponding slots provided therefor in the barrel 35. Coupling each of the detents 52 there is provided a detent holder pin 54. Pin 54 is provided for holding the detents 52 in the frame assembly 3. Rearward of the detents 52 there is provided a slide stop 55. Coupled to the slide stop 55 there is provided a slide stop spring member 56 for applying a spring force to the slide stop.

The spring forces the slide stop downwardly. After the last round is fired and the slide 2 is pushed back by the recoil, a magazine spring pad in the magazine contacts and pushes upwardly on the slide stop 55. The upward pushing causes the stop 55 to compress the spring 56 and project the slide stop 55 above the surface of the frame 3 and in to the slide stop receiving recess of the slide 2.

After the firearm is reloaded with a fresh magazine, the slide 2 is pulled backwards. This causes the slide stop 55 to be returned downwardly by the spring 56. By releasing the slide 2, the force of the spring 32 will cause the slide 2 to move to the ready-to-fire position.

Figure 12:
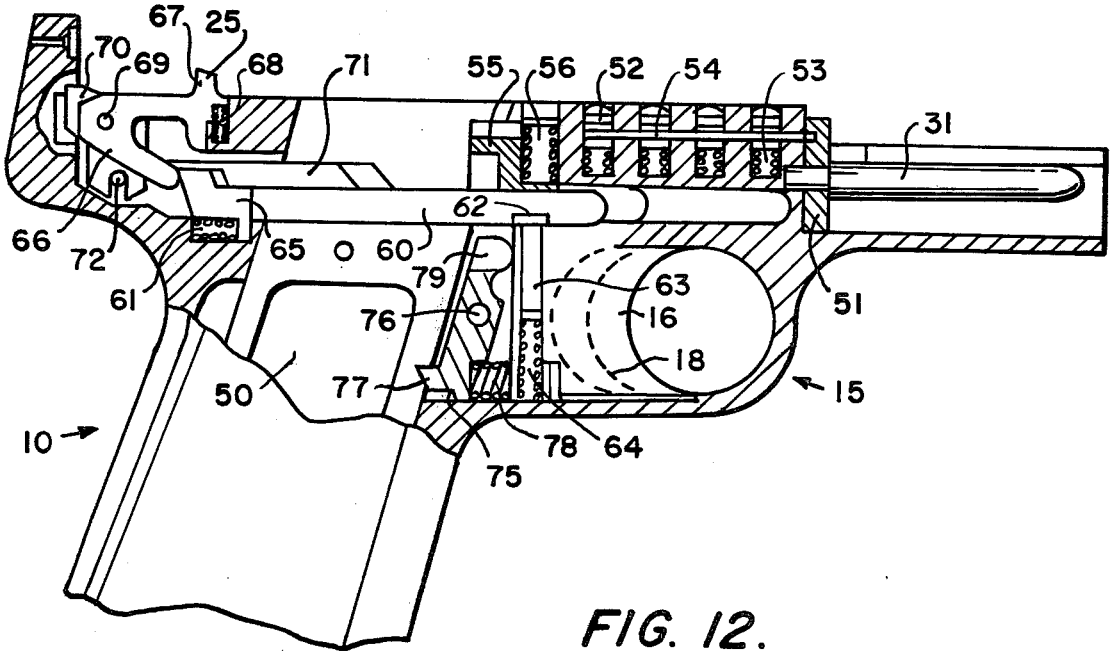
FIG. 12 is a cross-sectional view taken along lines 12—12 of FIG. 10.
Figure 10:
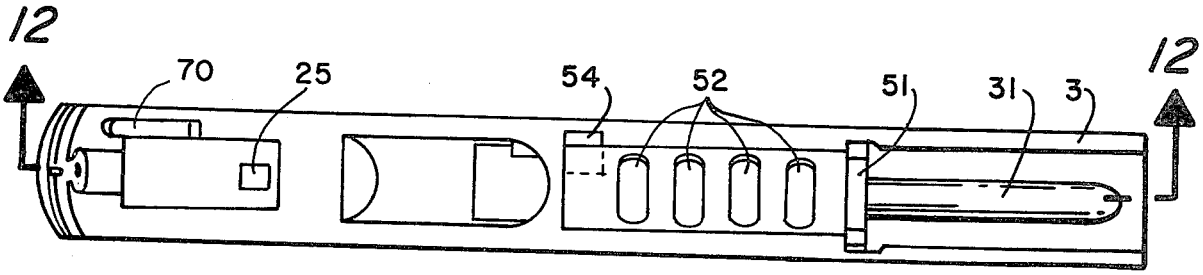
FIG. 10 is a top plan view of the frame assembly of FIGS. 1-5.
Figure 11:
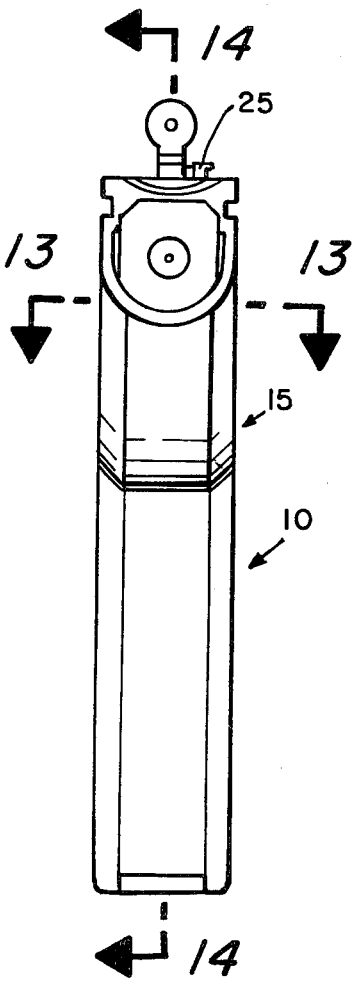
FIG. 11 is a forward end elevation view of FIG. 10.
Figure 9:
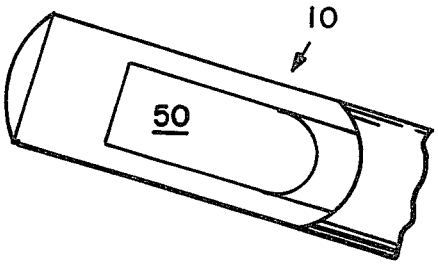
FIG. 9 is a bottom plan view of the handle portion of FIG. 1.

For firing the firearm there is provided in a trigger-actuated firing assembly, as seen in FIG. 12, an elongated firing trigger linkage member 60. Beneath the rear end of the linkage member 60 there is provided a firing trigger linkage spring member 61. The spring member 61 is provided for applying a spring force to the linkage member 60 to move the member 60 in a forward direction. At the forward end of the linkage member 60 there is provided a notch 62. The notch 62 is provided for removably receiving a firing trigger linkage detent 63. Below the detent 63 there is provided a spring member 64. The spring member 64 is provided for resiliently holding the detent 63 in the notch 62. At its rear end, the linkage 60 is provided with an upstanding member 65 for engaging a leg 66 which is one of a pair of downwardly depending legs of the sear 25. At its upper end sear 25 is provided with a firing pin assembly engaging member 67 for engaging the member 24 in the firing pin assembly 20, as will be further described below. Adjacent to the member 67 there is provided a sear spring member 68. The spring member 68 is provided for moving the sear 25 and in particular the sear member 67 into the path of travel of the firing pin assembly 24 for cocking the firing pin assembly. For pivotably coupling the sear 25 to the frame assembly 3 there is provided a pin member 69.

Figure 15:
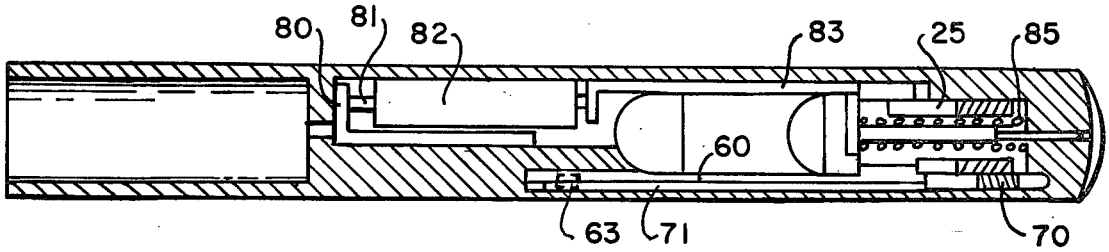
FIG. 15 is a cross-sectional plan view taken along lines 15—15 of FIG. 14.

To the left of the sear 25, as seen in FIG. 15, there is provided a firing trigger release linkage pivot bracket 70. Bracket 70 is pivotably mounted to the frame assembly 3 on the pin 69 used for mounting the sear 25 thereto. At the bottom of the bracket 70, the bracket 70 is movably coupled to a firing trigger detent release linkage member 71 by means of a pin 72.

Referring to FIG. 12, there is provided in a trigger-actuated magazine-latching assembly according to the present invention a magazine-latching member 75 which is pivotably attached to the frame assembly 3 by means of a magazine latch pin 76. At the lower end of the magazine-latching member 75 there is provided a detent 77. The detent 77 is provided for engaging a notch provided therefor in a magazine inserted in the magazine-receiving cavity 50 in the handle 10. On the side of the magazine-latching member 75 opposite the detent 77 there is provided a spring member 78. At the upper end of the latching member 75 there is provided a protuberance 79 for engaging a rear surface of the trigger member 18.

Figure 14:
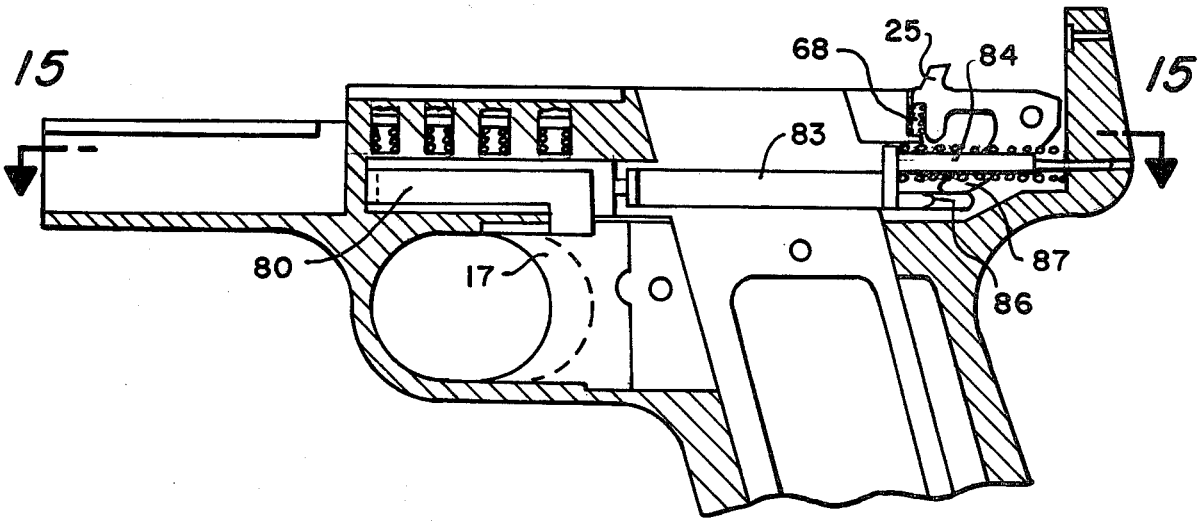
FIG. 14 is a partial cross-sectional view taken along lines 14—14 of FIG. 11.
Figure 5:
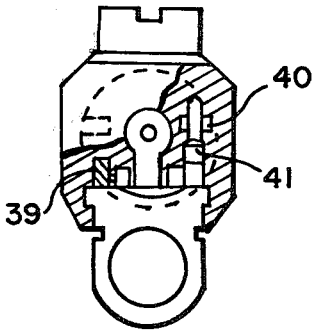
FIG. 5 is a partially broken away rear-end view of the slide assembly of FIG. 1 showing a shell extractor and the slide safety mechanism.
Figure 6:
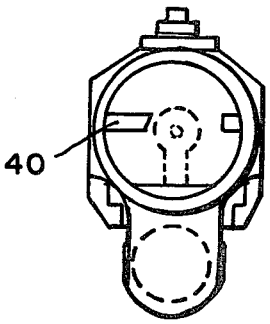
FIG. 6 is a front end elevation view of the slide assembly of FIG. 1.
Figure 8:
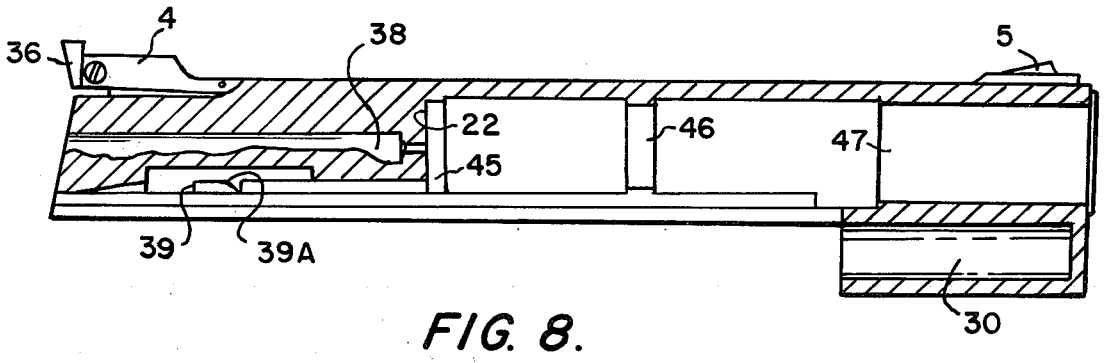
FIG. 8 is a partially broken away cross-sectional elevation view taken along and in the direction of lines 8—8 of FIG. 2 showing the firing pin assembly cavity, a part of the slide safety mechanism, sear-receiving cavity and recoil-spring-receiving cavity of a slide assembly according to the present invention.
Figure 7:
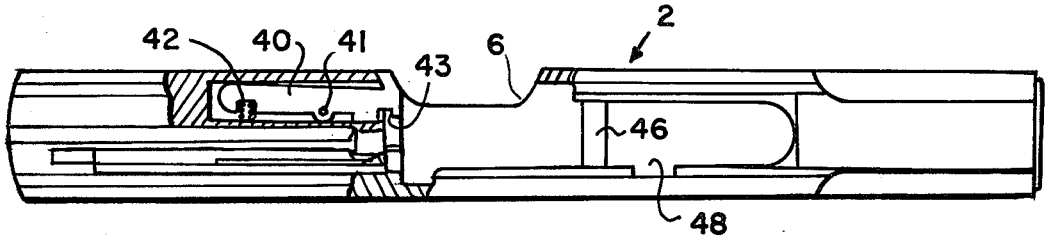
FIG. 7 is a partially broken away bottom plan view of the slide assembly of FIG. 1 showing the extractor and slide safety mechanism of FIG. 5.
Figure 13:
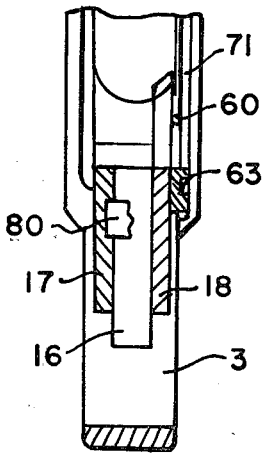
FIG. 13 is a partial cross-sectional view taken along lines 13—13 of FIG. 11.

Referring to FIGS. 13–15 there is provided in the self-retracting firing safety mechanism according to the present invention a self-retracting safety mechanism actuator bracket 80. One end of the bracket 80 is attached to the safety trigger member 17. The opposite end of the bracket 80 is positioned for actuating a pin 81 in a safety assembly mechanism 82. As will be described below with respect to FIGS. 20–22, the safety assembly mechanism 82 comprises a ballpoint pen point extending and retracting type mechanism. At the opposite end of the mechanism 82, the mechanism 82 is coupled to a safety mechanism linkage member 83. Extending from the rear end of the linkage member 83 there is provided an indicator pin member 84. Coaxial with the pin member 84 there is provided a safety mechanism spring member 85. Below the pin member 84 and spring member 85 and extending rearwardly from the safety mechanism linkage member 83 there is provided a slide link 86 for extending under the opposite leg 87 of the sear 25.

Referring to FIGS. 16–19, the firing trigger member 16 is releasably connected to the firing trigger linkage member 60 by means of the spring-loaded firing trigger linkage detent 63. As the trigger 16 is pulled or squeezed in a conventional manner by a finger of an operator of the firearm, the trigger member 16 moves the firing trigger linkage member 60 rearwardly causing the firing trigger linkage member 65 to contact the leg member 66 of the sear 25. Further squeezing of the trigger 16 causes the sear 25 to pivot about the pin 69 against the force of the spring member 68. As the sear 25 pivots about the pin 69 against the force of the spring 68, it is removed from engagement with the corresponding sear engaging member 24 which extends from the firing pin assembly mechanism 20. As the sear 25 is removed from the member 24, the firing pin assembly 20 is released. When the firing pin assembly 20 is released, it is propelled forwardly by a spring member causing the firing pin 21 to strike the primer of a round located in the firing chamber 23. The striking of the firing pin on the primer of the round in the firing chamber causes the round to be fired.

Figure 19:
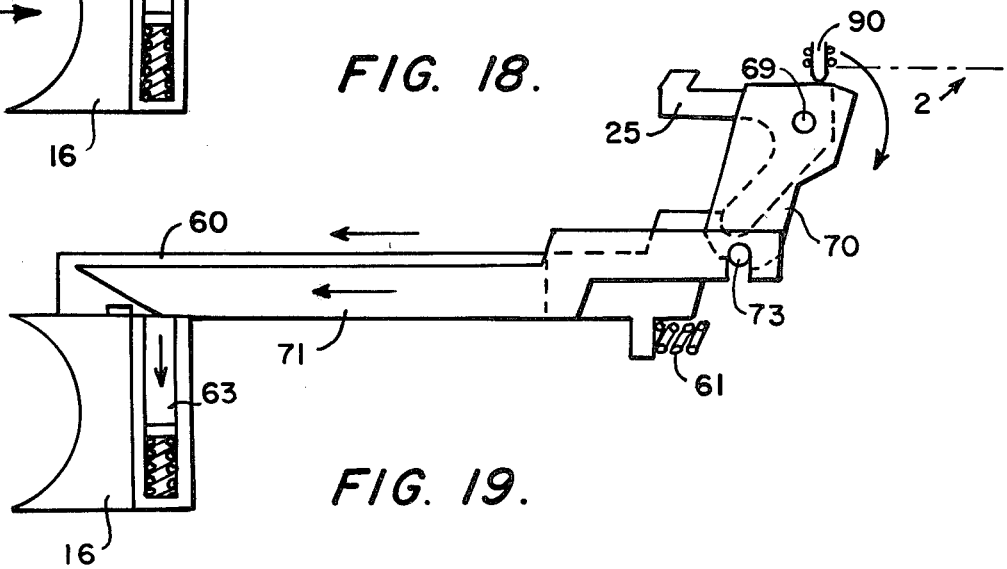
FIG. 19 is a side elevation view of FIG. 18 showing the position of the parts thereof upon actuation of the trigger release slide.
Figure 16:
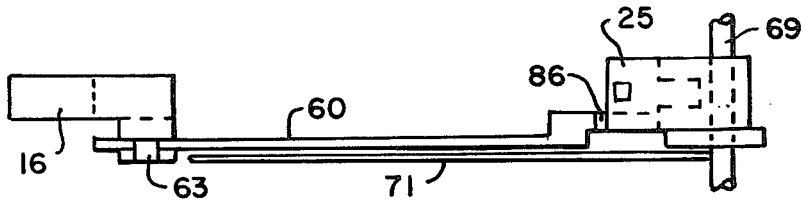
FIG. 16 is a top plan view of a firing trigger assembly according to the present invention.

When the round in the firing chamber 23 is fired, the reaction thereto on the slide 2 causes the slide 2 to move rearwardly as illustrated in FIG. 19 by the arrow adjacent the phantom line representation of the slide 2. As the slide moves rearwardly, a spring-loaded member 90 in the slide contacts the upper surface of the firing trigger release linkage pivot bracket 70. The contacting of the member 90 of the slide 2 with the pivot 70 causes the pivot bracket 70 to pivot about the pin member 69 in a clockwise direction, as shown in FIG. 19, causing the lower end thereof to move forwardly. Because the lower end of the pivot bracket 70 is connected to the firing trigger detent release linkage member 71 by means of the pin 73, the linkage member 71 is caused to move forwardly. As the linkage member 71 moves forwardly it overrides the firing trigger detent 63 causing it to be pushed downwardly against the spring 64 thereby disengaging the trigger member 16 from the firing trigger linkage member 60. The disengaging of the trigger member 16 from the firing trigger linkage member 60 allows the sear 25 to be returned by means of the spring 68 to its initial pre-firing position to engage the firing pin sear-engaging member 24 in preparation for the next round, even though the operator of the firing arm inadvertently fails to release the trigger member 16.

Figure 17:
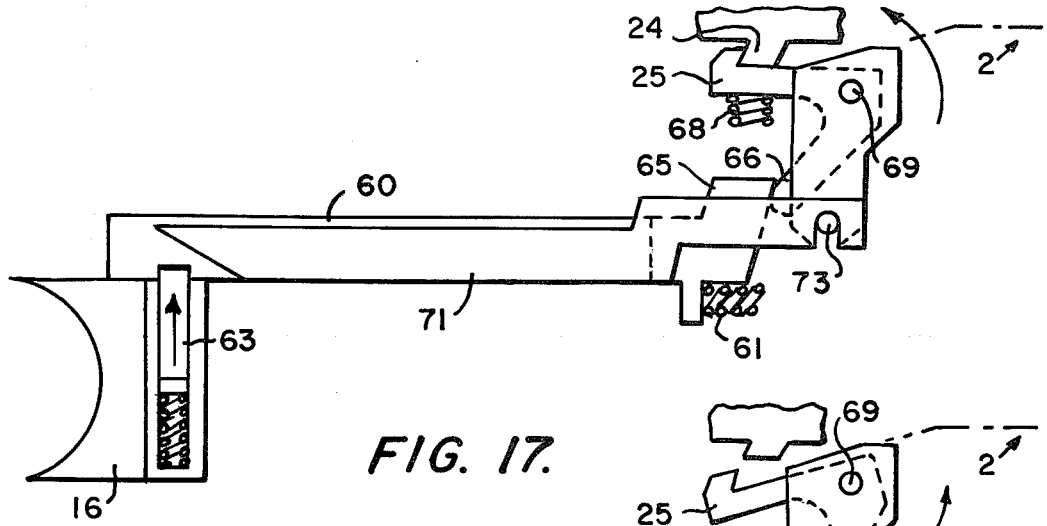
FIG. 17 is a side elevation view of FIG. 16.
Figure 18:
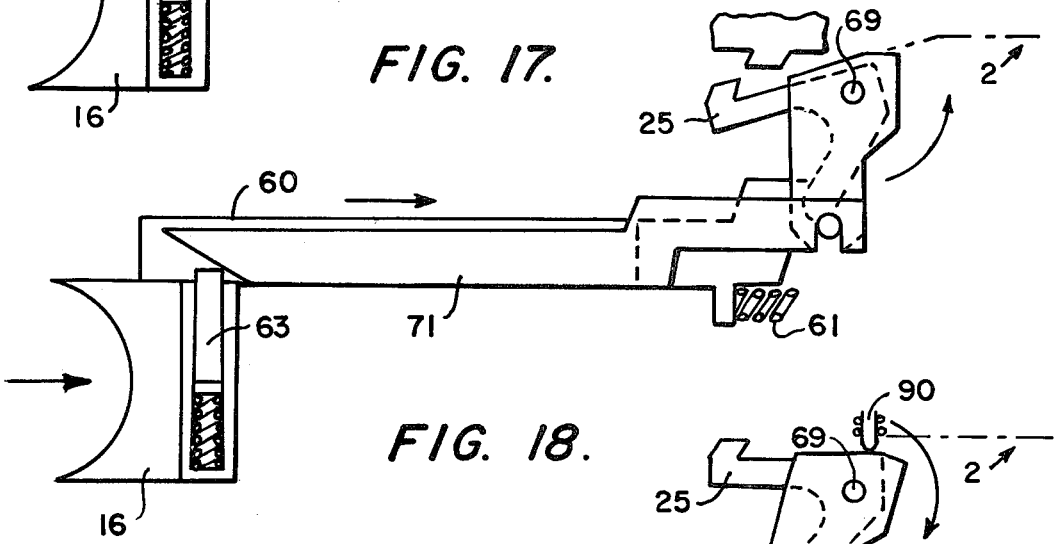
FIG. 18 is a side elevation view of FIG. 17 showing the position of the parts thereof upon activation of the sear.

With the sear 25 returned to its initial position for re-engaging the firing pin assembly sear-engaging member 24, the slide 2 moves forwardly returning to its initial pre-firing position, as shown in FIG. 17. As the slide 2 moves forwardly, the pivot bracket member 70 is pivoted counterclockwise as shown by the arrow about the pin 69. The counterclockwise pivoting of the member 70 causes the lower end of the member 70 and the pin 73 to return the firing trigger detent release linkage member 71 to its initial pre-firing position for readying the trigger-actuated firing assembly for the firing of another round.

Referring to FIGS. 20–23, there is provided in the safety assembly mechanism 82 a pair of movable members 102 and 103. The member 102 is located at the end of the pin member 81. The member 103 is coupled to the safety mechanism linkage member 83. The members 102 and 103 are slidably mounted in a cylindrical cavity formed by a housing 104. In its interior the housing 104 is provided with camming means for positioning the members 102 and 103 as they are moved from one end of the cylindrical cavity to the other in response to and against the spring force of the spring 85. The operation of the safety mechanism 82 and its various component parts such as the movable members 102 and 103 is substantially identical to the operation of a ballpoint pen point extending and rectracting type mechanism. At the opposite end of the assembly the indicating pin 84 is provided to pass through a hole provided therefor in the rear of the firing arm represented generally by phantom lines designated as 105.

In operation a squeezing or rearward movement of the self-retracting safety trigger member 17 moves the bracket 80 into contact with the pin 81. Assuming that the safety assembly is initially in a "safety-off" position, the rearward movement of the pin 81 against the spring force 85 moves the members 102 and 103 causing them to be locked in a rearward position, as shown in FIG. 21. This rearward movement and locking of the members 102 and 104 corresponds to the extension and locking in an exposed position, the ballpoint of a ballpoint pen. The rearward movement of the members 102 and 103 move the linkage member 83 rearwardly causing the slide link 86 to be moved beneath the leg member 87 of the sear 25. With the linkage member 86 located beneath the leg 87 of the sear 25, the sear 25 is prevented from being rotated counterclockwise about the pin 69. At the same time that the member 86 is moved into a position obstructing the movement of the sear 25, the indicating pin 84 is projected beyond the rear edge of the firearm for providing a visual indication to the user thereof that the safety assembly is in its "safety-on" position.

Referring to FIG. 22, a subsequent activation of the self-retracting safety trigger member 17 returns the assembly to its initial position whereby the members 102 and 103 are moved to the left of their position in FIG. 20. In response to the spring force 85, as the members 102 and 103 are moved to the left of their position as shown in FIG. 20, the members 83 and 86 are also withdrawn thereby removing the member 86 from the path of travel of the leg 87 of the sear 25. With the member 86 moved from the path of travel of the leg 87 of the sear 25, the sear 25 can be pivoted by the firing trigger assembly as described above with respect to FIGS. 17–19. When the safety assembly is moved to ist "safety-off" position, the indicating pin member 84 is withdrawn into the housing or frame 105 for providing a visual indication to the operator of the firearm that indeed the safety is in its "safety-off" position.

Referring to FIGS. 23–25, to operate the trigger-actuated magazine-latching mechanism, the trigger 18 is pulled or squeezed against the force of the spring member 78 and contacts the protuberance 79 of the latching member 75. As the trigger 18 contacts the protuberance 79 of the latching member 75, the latching member 75 is caused to pivot about the pin 76 withdrawing the detent 77 located at the bottom thereof from the notch provided therefor in the magazine 13. When the detent 77 is removed from the notch provided therefor in the magazine 13, the magazine 13 is free to be removed from the handle 10.

To insert a magazine 13 in the handle 10, the magazine is simply slid into the handle. As it contacts the latching member 75, the latching member 75 is caused to pivot about the pin 76 against the force of spring 78 until the detent 77 is in registration with the notch provided therefor in the magazine. When the detent 77 is in registration with the notch provided therefor in the magazine 13, the spring 78 forces the detent into the notch, thereby latching the magazine in the handle 10.

A preferred embodiment of each feature of the present invention having been described, it is contemplated and understood that modifications may be made to the embodiments without departing from the spirit and scope thereof. Accordingly, it is intended that the scope of the present invention be not determined solely by reference to the embodiments described, but rather be determined by reference to the claims hereinafter provided and their equivalents.

What is claimed is:

1. In a firearm having a firing mechanism, a safety mechanism comprising: a self-retracting safety trigger member and a movable safety assembly having a safety-on and a safety-off position responsive to successive finger pullings of the safety trigger member, a first of such pullings inhibiting and a second of such pullings enabling the operation of said firing mechanism in the firearm.

2. A safety mechanism according to claim 1 wherein the self-retracting movable safety assembly responsive to successive actuations of the safety trigger member comprises:

a slide link; and means coupling the slide-link and the self-retracting safety trigger member for successively moving the slide-link between a self-retracting safety-on position wherein the slide-link inhibits the operation of the firing mechanism and a safety-off position wherein the slide-link enables the operation of the firing mechanism.

3. In a firearm wherein the firing mechanism comprises a movable sear, a safety mechanism according to claim 2 wherein the slide-link comprises means which is moved into the path of movement of the sear when the slide-link is moved to its safety-on position for inhibiting a movement of the sear and which is moved from the path of movement of the sear when the slide-link is moved to its safety-off position for enabling a movement of the sear.

4. A safety mechanism according to claim 1 comprising means for visually indicating when the movable safety assembly is in its safety-on position and when it is in its safety-off position.

5. A safety mechanism according to claim 4 wherein the visual indicating means comprises a pin member which extends from the movable safety assembly through and externally from a hole provided therefor in the housing of the firearm and is visible when the movable safety assembly is in its safety-on position and is retracted by the movable safety assembly into the hole and is hidden from view when the movable safety assembly is in its safety-off position.

6. A safety mechanism according to claim 1 wherein said safety trigger member and movable safety assembly comprises:

means forming a cylindrical cavity in the firearm having a plurality of curved surfaces and channels forming camming surfaces in the interior walls thereof, said channels comprising at least two different lengths corresponding, respectively, to an extended safety-on and a retracted safety-off position;

means forming a cam follower slidably disposed within the cavity having radially extending parts for slidably engaging and following the curved surfaces and channels as the cam follower is moved in the cavity channels;

means extending from the cam follower and which moves with the cam follower for inhibiting and operation of the firing mechanism when the cam follower is in a channel corresponding to the extended safety-on position and which is moved to a position for enabling the operation of the firing mechanism when the cam follower is in a channel corresponding to the retracted safety-off position; and a spring member, said moving means comprising means forming a bracket actuator extending from the cam follower against the force of the spring member as the safety trigger member is moved successively rearwardly by a finger.

7. In a firearm having a firing mechanism comprising a sear, a safety mechanism according to claim 6 wherein the means extending from the cam follower for inhibiting and enabling the firing mechanism comprises means for inhibiting and enabling a movement of the sear.

8. In a firearm having a firing trigger, a self-retracting safety mechanism according to claim 1 wherein the self-retracting safety trigger member and the firing trigger are slidably mounted side by side in the housing of the firearm.

9. A safety mechanism according to claim 8, wherein the forward edge of the self-retracting safety trigger member is positioned rearwardly of the forward edge of the firing trigger so that the firing trigger and self-retracting safety trigger member can be operated by finger pressure independently.

10. In a firearm having a firing mechanism, a safety mechanism comprising:

a safety trigger member slidably mounted in a trigger housing for slidable movement toward the rear of the firearm by a finger;

a bracket actuator extending from and movable with a movement of the safety trigger member;

a cylinder;

a piston slidably mounted in the cylinder in a position to be moved rearwardly by the bracket actuator;

a plunger slidably mounted in the cylinder in a position to be moved rearwardly by the piston;

a slide-link slidably mounted in a position to be moved rearwardly by the plunger; and a spring member for providing a force opposing of rearward movement of the piston, plunger and slide-link for moving the piston, plunger and slide-link between a safety-on and a safety-off position to successively inhibit and enable the operation of the firing mechanism in response to successive actuations of the safety trigger member.

11. In a firearm having a firing mechanism including a sear, a safety mechanism according to claim 10 wherein the slide-link comprises means for inhibiting a movement of the sear when the slide-link is in its safety-on position and enabling a movement of the sear when the slide-link is in its safety-off position.

12. A safety mechanism according to claim 11 wherein the sear inhibiting and enabling means comprises means which moves into the path of travel of the sear when the slide-link is moved to its safety-on position.

13. A safety mechanism according to claim 10 comprising means for providing a visual indication of when the slide-link is in its safety-on position and when it is in its safety-off position.

14. A safety mechanism according to claim 13 wherein the visual indicating means comprises a pin member which extends from the slide-link through and externally from a hole provided therefor in the housing of the firearm and is visible when the slide-link is in its safety-on position and is retracted by the slide-link into the hole and is hidden from view when the slide-link is in its safety-off position.

15. A firearm comprising:

a plurality of triggers, each coupled to a trigger-actuated mechanism for actuating the mechanism, at least one of which is a self-retracting safety trigger responsive to successive finger pullings, a first of such pullings inhibiting and a second of such pullings enabling the operation of a firing mechanism in said firearm; and means for mounting said plurality of triggers side by side in the firearm.

16. A firearm according to claim 15 wherein one of said plurality of triggers is coupled to said firing mechanism and said self-retracting safety trigger is coupled to a safety mechanism.

17. A firearm according to claim 15 wherein said self-retracting safety trigger is coupled to a safety mechanism and another of said triggers is coupled to a magazine latching mechanism.

18. A firearm according to claim 15 wherein one of said plurality of triggers is coupled to said firing mechanism, said self-retracting safety trigger is coupled to a safety mechanism and another of said plurality of triggers is coupled to a magazine-latching mechanism.

* * * * *